US005873521A

United States Patent [19]

Ernst

[11] Patent Number: 5,873,521

[45] Date of Patent: Feb. 23, 1999

[54] CHILDREN'S PLAY APPARATUS

[75] Inventor: Nile Ernst, Carlsbad, Calif.

[73] Assignee: Nilo Enterprises, Inc., Carlsbad, Calif.

[21] Appl. No.: 831,386

[22] Filed: Apr. 1, 1997

[51] Int. Cl.[6] ..... A63H 18/00

[52] U.S. Cl. ..... 238/10 A; 104/126

[58] Field of Search ..... 104/124, 125, 104/126; 238/10 R, 10 A, 10 E, 10 F; 108/27, 28, 29, 149, 161

[56] References Cited

U.S. PATENT DOCUMENTS

| | | | |
|---|---|---|---|
| 1,911,241 | 5/1933 | Rosenthal | 238/10 A |
| 2,088,077 | 7/1937 | Wood | 108/27 |
| 2,198,306 | 4/1940 | Fisher | 238/10 A |
| 2,258,689 | 10/1941 | Roselyn | 108/27 |
| 2,633,087 | 3/1953 | Hadaway | 104/125 |
| 3,589,056 | 6/1971 | Glass | 46/16 |
| 3,589,064 | 6/1971 | Harada | 46/243 |
| 3,594,940 | 7/1971 | Yonezawa | 46/16 |
| 4,068,402 | 1/1978 | Tanaka | 46/216 |
| 4,964,833 | 10/1990 | Suzuki | 446/118 |
| 4,964,834 | 10/1990 | Myller | 446/118 |
| 5,421,762 | 6/1995 | Glickman | 446/126 |

*Primary Examiner*—Mark Tuan Le
*Attorney, Agent, or Firm*—J. E. Brunton, Esq.

[57] ABSTRACT

A children's play apparatus which includes a specially designed play table that can be used with commercially available toys including toy trains and train tracks, and one that can also be used with specifically designed modules for supporting sections of wooden train track in the unique configurations. More particularly, in using the play apparatus, the specially designed modules of the invention can be used to extend the track beyond the boundaries of the play table and which, due to the stackability of the modules can also be used to attain virtually unlimited track heights above the surface of the table and outwardly from the surface of the table top.

15 Claims, 5 Drawing Sheets

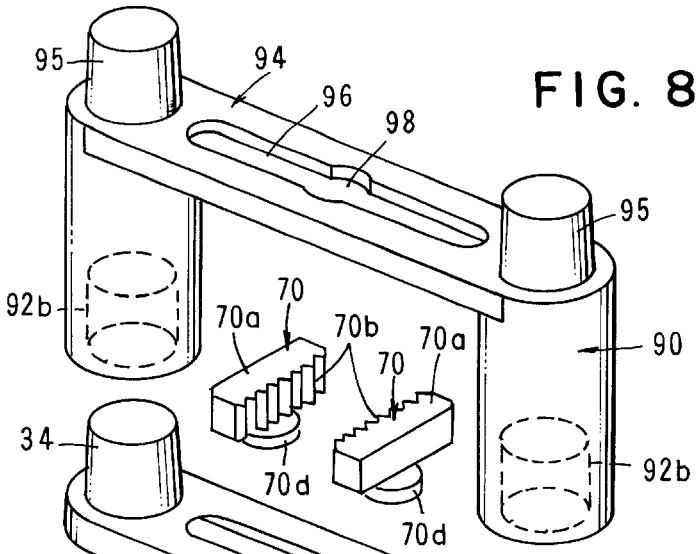
FIG. 8
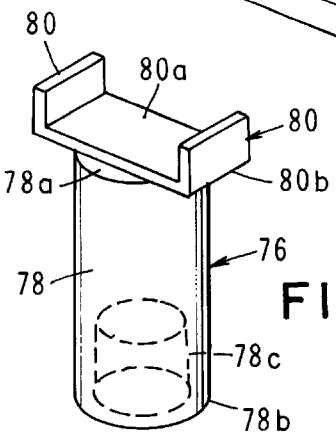
FIG. 4
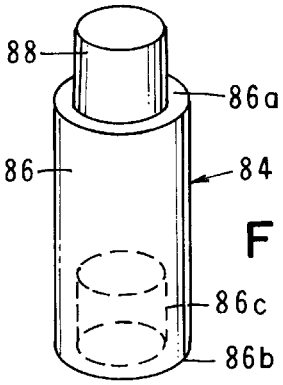
FIG. 5
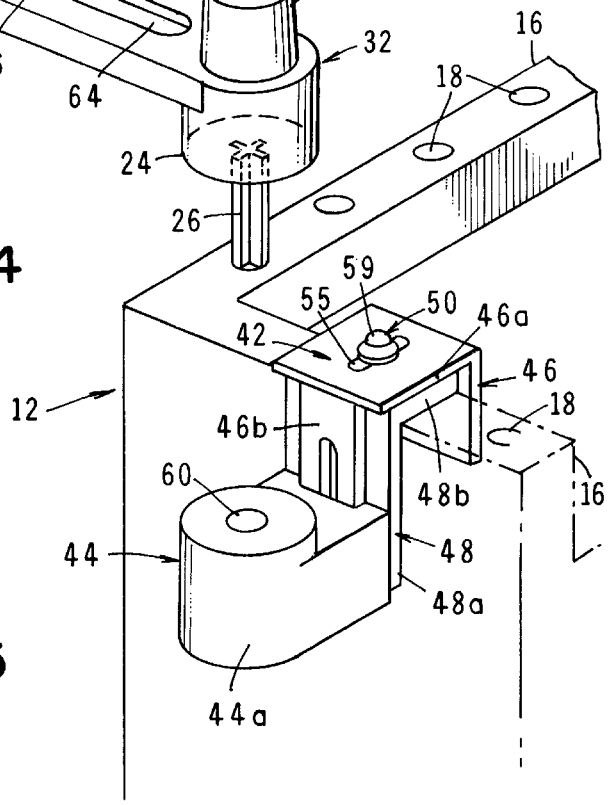

CHILDREN'S PLAY APPARATUS

BACKGROUND OF THE INVENTION

Field of the Invention

The present invention relates generally to children's play things. More particularly, the invention concerns a children's play apparatus made up of a play table and a number of cooperating modules which can be used to support interconnectible sections of toy train track at various locations relative to the surface of the play table.

DISCUSSION OF THE INVENTION

A number of different types of children's play tables have been suggested in the past. These play tables typically have a top surface which is supported by table legs at a convenient height to enable play on the table by small children with toys such as building blocks, games, puzzles and the like.

A favorite use of the prior art play tables is to construct toy railways on the top surface of the table. These toy railways typically include sections of wood toy train track which are of various shapes and sizes and which can be easily interconnected by the child to form elaborate, circuitous toy train tracks along which a toy train can be rolled. Such tracks and toy trains are commercially available from a number of companies such as Brio Corporation of Milwaukee, Wis. and Learning Curve Toys of Chicago, Ill. Track sections available from these and other companies include straight and curved track sections as well as ascending and descending track sections. Ramps and track supports of various kinds are often provided along with the track sections so that portions of the toy train track can be elevated relative to the top of the table to simulate road and river crossings. Apparently, the more complex the toy train track becomes the more the child enjoys the task of track construction. Accordingly, manufactures of the toy trains have designed elaborate track sections which include switching sections, "Y" sections, "T" crossing sections and sections having complex ascending and descending curves.

The thrust of the present invention is to provide a specially designed play table that is not only usable with the commercially available toy trains and toy train tracks, but is also usable with specially designed extension and elevation modules, which along with the table, comprise the play apparatus of the invention. The extension modules of the invention uniquely function to enable sections of the toy train track to be extended beyond the margins of the table. Similarly, the elevation modules permit sections of the track to be superimposed over one another as they extend beyond the boundaries of the table and as they extend above objects such as roads, bridges and the like which have been placed on the surface of the play table.

SUMMARY OF THE INVENTION

It is an object of the present invention to provide a novel children's play apparatus which includes a specially designed play table that can be used with commercially available toys including toy trains and train tracks, and one that can also be used with specifically designed modules for supporting sections of the wooden train track in the unique configurations.

More particularly, it is an object of the invention to provide a play apparatus of the aforementioned character in which the specially designed modules of the invention can be used to extend the track beyond the boundaries of the play table and which, due to the stacking ability of the modules, can also be used to attain virtually unlimited track heights above the surface of the table.

Another object of the invention is to provide a play apparatus of the character described in the preceding paragraphs which is of simple design, is easy to use and provides exciting new ways to play with commercially available toys including toy train sets.

Another object of the invention is to provide a play apparatus which is desirable in use and one which can be inexpensively manufactured in quantity.

BRIEF DESCRIPTION OF THE DRAWINGS

FIG. 4 is a generally perspective view of an alternate form of elevation module of the invention.

FIG. 5 is a generally perspective, view of another form of elevation module which is interconnectible with the module shown in FIG. 4.

FIG. 8 is a generally perspective, exploded view of an assemblage comprising an alternate form of extension adapter of the invention which is used to extend the toy train track beyond the margins of the play table and upon which the gripping means is mounted and a cooperating elevation module which is used to stack a second section of track above the extension module.

DESCRIPTION OF THE INVENTION

Figure 1:
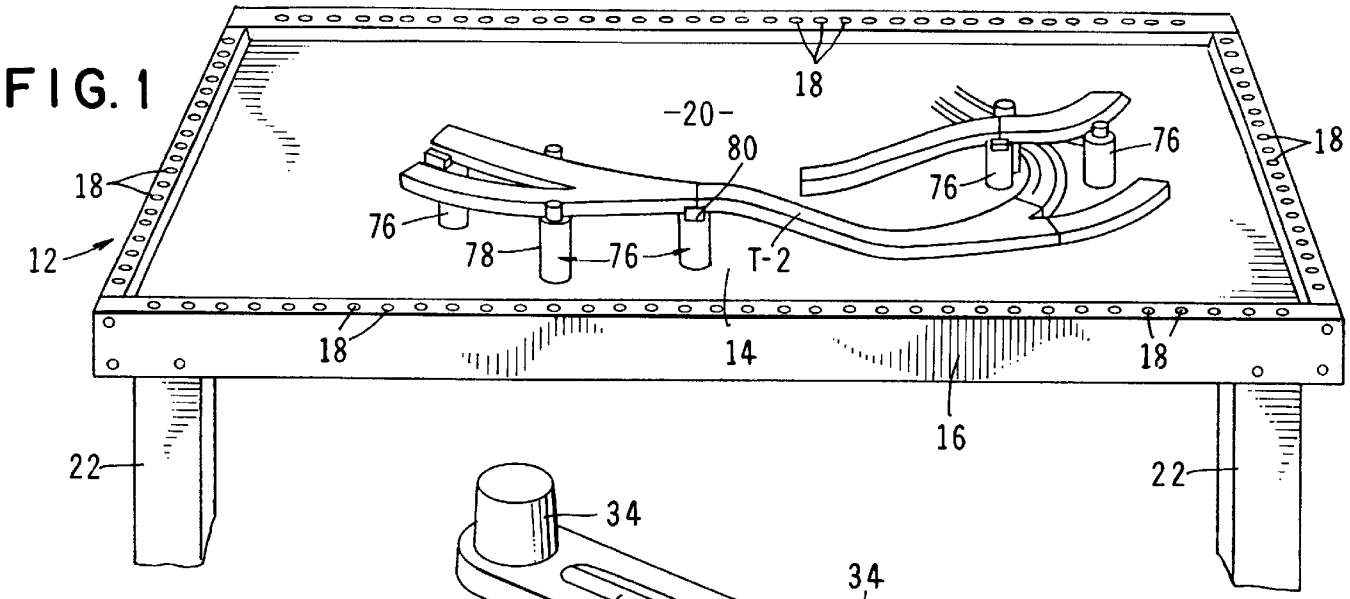
FIG. 1 is a generally perspective view of one form of the play table of the invention showing the start of construction of a toy train track.
Figure 2:
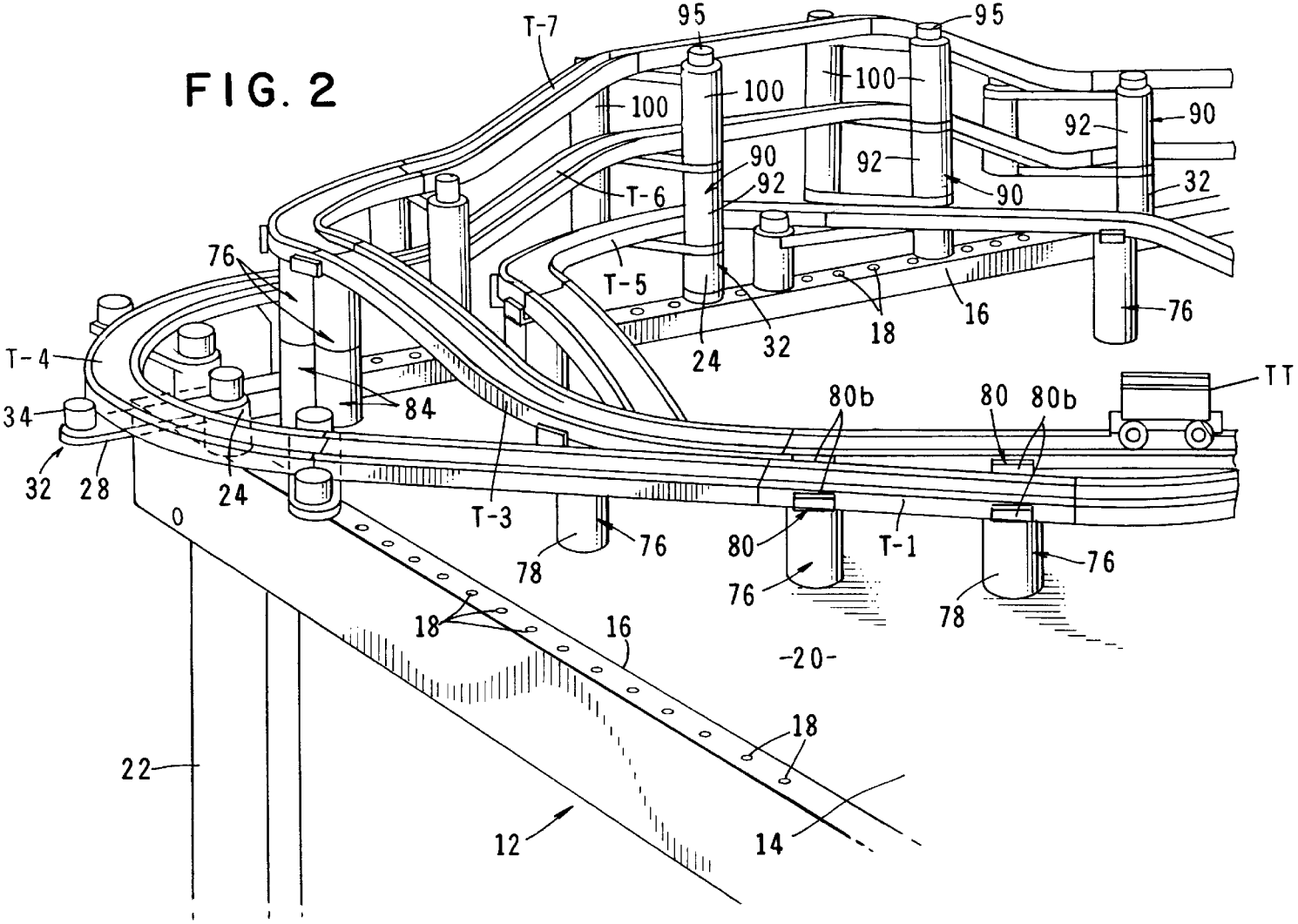
FIG. 2 is an enlarged, generally perspective view of the completed assembly of the train track illustrating the use of the various cooperating modules of the invention to permit extension of the track beyond the borders of the play table and into an elevated, stacked configuration.

Referring to the drawings and particularly to FIGS. 1 and 2, one form of the children's play apparatus of the present invention is there illustrated. The apparatus is designed for use with interconnectible sections of wooden toy train track which include straight, curved, flat, ascending and descending track sections that can be connected together to form an elongated toy train track. The apparatus shown in FIGS. 1 and 2 comprises a play table 12 having a central portion 14 and an upstanding border 16 which circumscribes central portion 14. Upstanding border 16 is provided with a multiplicity of spaced-apart, generally vertically extending bores 18, the purpose of which will presently be described. As best seen in FIG. 1, central portion 14 of the play table has an upper, generally planar, article-supporting surface 20 which adapted to support various toys, including model train sets of a character readily commercially available from sources such as Brio Corporation. Surface 20 is elevated to a convenient height for play by a plurality of generally vertically extending floor engaging legs 22.

Forming important aspects of the present invention are extension means for extending sections of the toy train track outwardly beyond border 16 of the play table (see, for example, left-hand portion of FIG. 2), connector means for connecting the extension means to the table and track elevation means supported by surface 20 for supporting straight, curved, ascending and descending sections of the toy train track (see FIG. 1). The nature and construction of these important extension, connector and elevation means will be described more fully in the paragraphs which follow.

Figure 3:
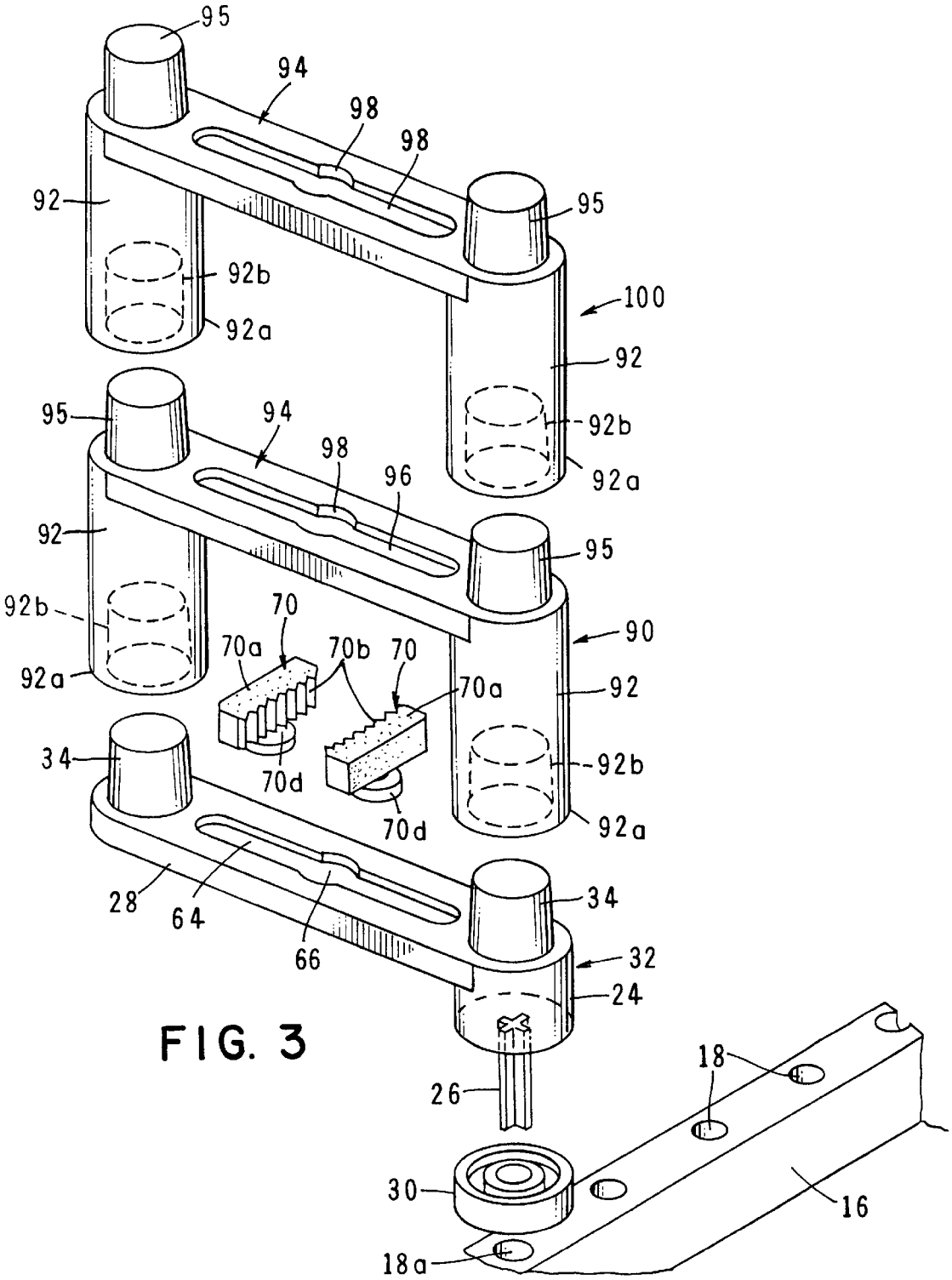
FIG. 3 is a generally perspective, exploded view of one form of the track elevation and extension modules of the invention.

Considering first the extension means of the invention, one form thereof is shown in FIG. 3 and can be seen to comprise a generally cylindrically shaped body portion 24, a downwardly extending, ribbed shank portion 26 connected to body portion 24, and a track supporting arm 28 which is connected to and extends outwardly from body portion 24. As indicated in FIG. 3, when this form of extension means is used, shank portion 26 comprises a part of the connector means of the invention and as such is inserted into a disk-shaped bearing element 30 and is then telescopically and rotatably received in a selected one of the vertically extending, spaced-apart apertures 18 which is identified in FIG. 3 as 18*a*. For reasons presently to be discussed, the extension means, or extension module, generally identified in FIG. 3 by the numeral 32 is also provided with a pair of spaced-apart, upstanding connector protuberances or tapered bosses 34.

Figure 6:
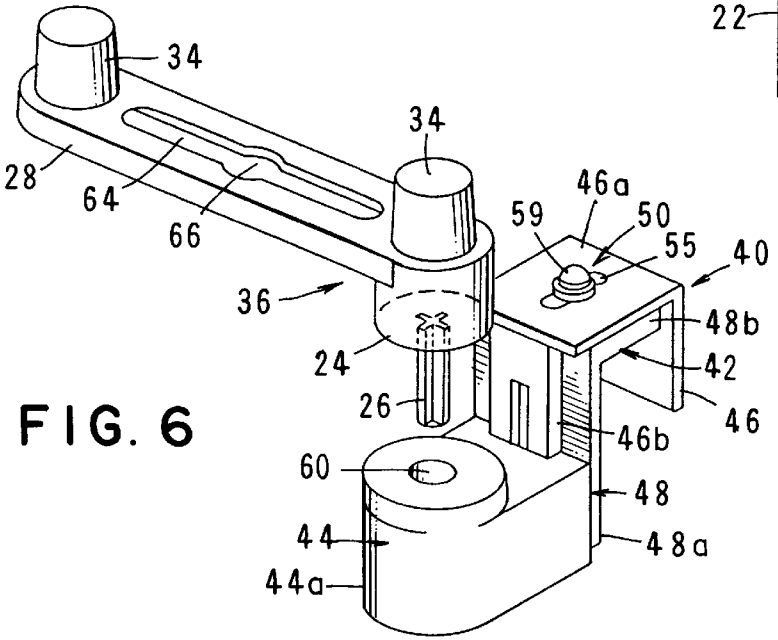
FIG. 6 is an enlarged, generally perspective view of one form of extension module of the invention which permits extension of the track beyond the borders of the play table.
Figure 9:
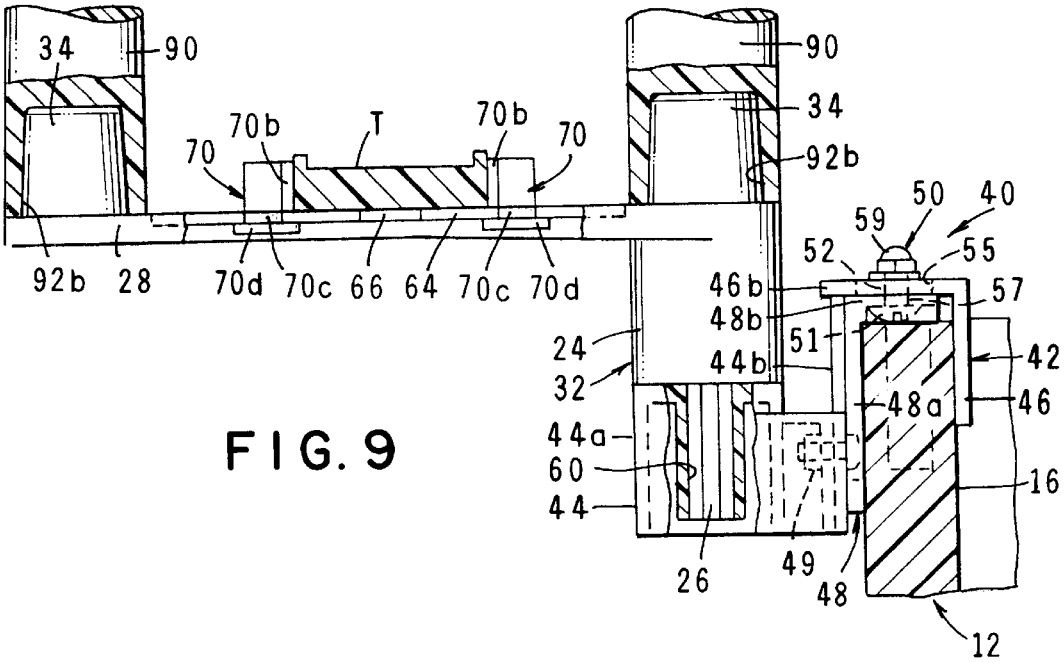
FIG. 9 is a fragmentary, cross-sectional view of the lower portion of the assemblage illustrated in FIG. 8.

Another form of the extension means of the invention is shown in FIG. 6 and comprises an extension module 36 which is of somewhat similar construction to extension 32 module shown in FIG. 3 and, accordingly, like numerals are used in FIG. 6 to identify like components. More particularly, module 36, like module 32, includes a body portion 24, a downwardly extending ribbed shank portion 26 and a track supporting arm 28. However, in this form of the invention, the connector means comprises a border adapter assembly generally designated by the numeral 40. Border adapter 40 is specially designed to be removably interconnected with the upstanding border 16 of the table 12 in the manner shown in FIG. 8. The border adapter of this form of the invention can also be used with. play tables in which the upstanding border does not have spaced-apart bores. In the present form of the invention, border adapter 40 includes a clamping assembly 42 and an adapter body portion 44 which includes a generally cylindrical body portion 44*a* and a slotted back element 44*b*. As best seen in FIGS. 8 and 9, clamping assembly 42 comprises a first generally L-shaped member 46 to which a second mating generally L-shaped member 48 is adjustably interconnected. L-shaped member 48 has a downwardly extending leg 48*a* to which back element 44*b* of body portion 44 is adjustably interconnected by a connector 49 (FIG. 9). Extending substantially perpendicularly to leg 48*a* is a generally horizontally extending leg 48*b* to which a generally horizontally extending leg 46*a* of L-shaped member 46 is slidably interconnected by a connector assembly 50 (FIG. 9). Connector assembly 50 includes a slotted head 51, a threaded shank portion 52 which extends through an opening 55 provided in leg 46*a* of member 46 and an opening 57 provided in leg 48*b* of member 48 (see FIG. 9). An internally threaded nut 59 can be threadably connected to shank 52 so as to secure L-shaped member 46 in a selected position relative to L-shaped member 48. With this construction, the clamping assembly can be adjusted to securely fit over and clamp against border 16 of the play table in the manner shown in FIGS. 8 and 9. Similarly, clamping assemblage 40 can be vertically adjusted relative to body 44 by loosening connector 49. While clamping assembly 40 can be used with the play table of the invention, it can also be used with other play tables having an upstanding margin. When used either with the play table of the invention or, alternatively, with another play table, shank 26 of the extension module is telescopically and rotatably received within a vertical bore 60 provided in body portion 44 (see FIGS. 6 and 9).

Figure 7:
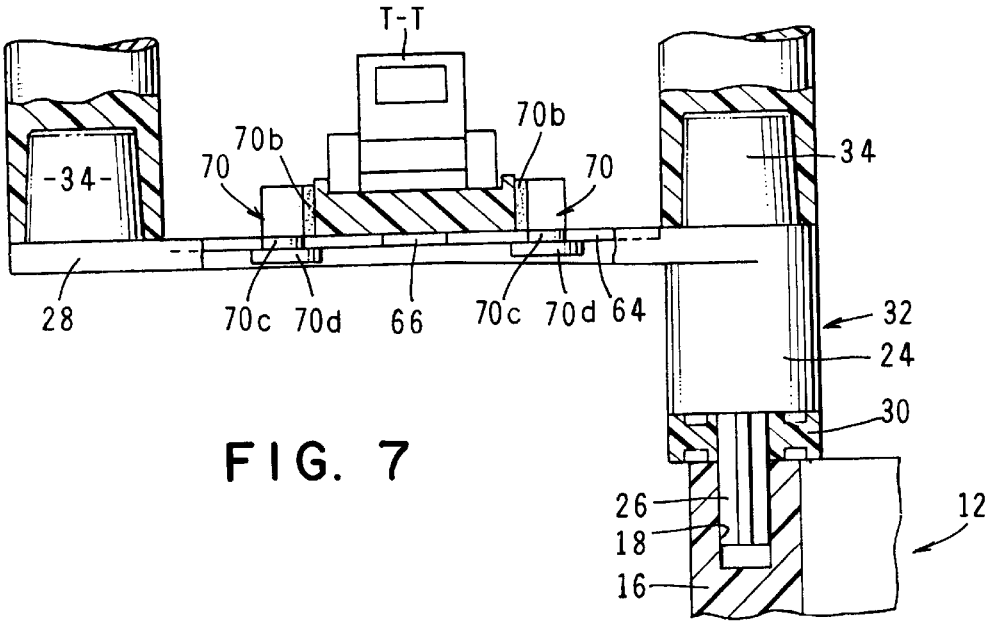
FIG. 7 is a cross-sectional view of an assemblage comprising a portion of the extension module of the invention shown in FIG. 6 with the track gripping means of the invention and showing a section of toy train track supported on the extension module.

As indicated in FIGS. 3 and 6, supporting arm 28 of the extension modules of the invention are provided with an elongated slot 64 which has a generally centrally disposed, enlarged diameter opening 66. Opening 66 and slot 64 is adapted to receive the track gripping means of the invention which here comprises a pair of cooperating track gripping jaws 70. Jaws 70 include a body portion 70*a* which is provided with a serrated track engaging face 70*b* for gripping engagement with a section of the toy train track. Connected to body portion 70 is a downwardly extending shank portion 70*c* which terminates in a generally circular-shaped head portion 70*d*. Each of the track members 70 is preferably formed of a yieldably deformable elastomeric material such as rubber or any other suitable elastomer. In the manner indicated in FIGS. 7 and 9, head portion 70*d* is receivable within opening 66 so that shank portion 70*c* of each of the gripping members can be slidably positioned within slot 64 to a position wherein serrated face 70*b* of the member moves into secure engagement with a section of track of the character illustrated in FIGS. 7 and 9 and generally designated as "T". As shown in FIGS. 2 and 7, a toy train "TT" is adapted to roll along the assembled track. The length of shank portion 70*c* is such that the upper surface of head 70*d* and the lower surface of body 70 positively frictionally engage the surfaces of supporting arm 26 so that one adjusted, the gripping means will securely hold the track "T" in position relative to the track in the manner shown in FIGS. 7 and 9. It is to be noted that with this construction, the track gripping means, or members 70, can also be positioned at various angles relative to supporting arm 28 so as to accommodate curved or angularly extending sections of track "T".

Turning next to FIGS. 4 and 5, simple forms of the track elevation means of the invention are there shown. In this particular embodiment, the track elevation means comprises an elevation module 76 which includes a generally, cylindrically shaped body portion 78 having first and second ends 78*a* and 78*b*. Provided proximate end 78*a* is a track receiving, generally U-shaped channel member 80 having a base portion 80*a* and a pair of spaced-apart track engaging arms 80*b*. Provided proximate second end 78*b* is a bore 78*c*, the purpose of which will presently be described. Referring once again to FIGS. 1 and 2, it can be seen that elevation module 76 can, by way of example, be used to support a straight track section identified in FIG. 2 as T-1. When used in this fashion, second end 78*b* of the module rests on table surface 20 with track section T-1 being supported by the generally U-shaped track-engaging member 80*b*. Reference should also be made to FIG. 1 wherein elevation module 76 is shown supporting one end of ascending train section identified in FIG. 1 as T-2.

Also forming a part of the elevation means of the invention is a second elevation module, which is shown in FIG. 5 and identified by the numeral 84. This module is adapted to cooperate with module 76 and also includes a generally cylindrically shaped body portion 86 having a first end 86*a* and a second end 86*b*. Formed on end 86*a* is an upstanding, tapered protuberance or boss 88 which is adapted to be telescopically and rotatably received within bore 78*c* of module 76. Formed proximate end 86*b* is a bore 86*c* which, in a manner presently to be described, can telescopically receive connecting bosses or protuberances of the various modules of the invention shown in the drawings. When it is desired to elevate the track a greater distance above surface 20 then is possible by using module 76 alone, module 76 can be stacked upon module 84 and can be used in the manner shown in FIG. 2 to support one end of an ascending track section there identified as T-3.

Referring next to FIG. 3, another form of the track elevation means of the invention is there illustrated and can be seen to comprise a first elevation module 90. Module 90 includes a pair of spaced-apart generally cylindrically shaped legs 92, a track supporting arm 94 which is connected to and spans legs 92 and a pair of spaced-apart, upstanding connector protuberances or bosses 95. Formed proximate the lower ends 92*a* of legs 92 are tapered, socket-like bores 92*b* which are adapted to telescopically receive bosses such as the bosses 34 provided on extension module 32. Track-supporting arm 94 is provided with an elongated slot 96 having an enlarged diameter central portion 98. Slot 96 is of identical construction to slot 64 of module 32 and functions to receive track-gripping jaws or members 70 in the identical manner previously described.

Also forming a part of this latest form of the track elevation means of the invention is a second elevation module 100. Module 100 is of identical construction to module 90 and includes tapered, socket-like bores 92*b* which can be mated with bosses 95 of module 90. Because module 100 is of identical construction to module 94, like numerals are used in the drawings to identify like components. It is to be noted that track-supporting arm 94 of module 100 is slotted in the manner previously described to enable the use therewith of track engaging jaws 70 if such use is deemed appropriate.

Turning to FIG. 8, it is to be observed that module 90 can also be used with the form of the extension means of the invention there shown with bosses 34 being closely received within sockets 92*b* of the elevation module (see also FIG. 9). In using the apparatus of the invention in the manner shown in FIG. 2, it is to be observed that extension module 32 can be used to support and extend a curved section of track T-4 beyond the boundary of the play table. Similarly, as shown in upper central portion of FIG. 2, the assemblage of the extension module and elevation modules shown in FIG. 3 can be used to support track sections T-5, T-6, and T-7. Further as illustrated in FIG. 2, various combinations of the extension modules and elevation modules of the invention can be used in connection with the play table to construct the highly novel and complex toy train track shown in FIG. 2, wherein portions of the tract extend beyond the boundaries of the table and variously shaped ascending and descending track sections can be supported by the elevation means of the invention using modules 90 and 100. Accordingly, through use of the apparatus of the invention, play is significantly enhanced since toy track constructions heretofore impossible with prior art; ie are now readily available to children using the novel play apparatus of the present invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A children's play apparatus for use with sections of a toy train track that can be connected together to form an elongated toy train track, said apparatus comprising:

(a) a play table having a central portion for supporting the sections of toy train track and an upstanding border circumscribing said central portion;

(b) extension means connected to said play table for extending a section of the toy train track outwardly beyond said border of said play table, said extension means comprising an extension module having a body portion and a track supporting arm connected to said body portion and extending outwardly therefrom; and (c) connector means for connecting said extension means to said border of said play table.

2. An apparatus as defined in claim 1 in which said boarder of said play table has a plurality of spaced bores and in which said connector means comprises a shank portion connected to said body portion of said extension means, said shank portion being removably receivable with a selected bore of said border of said play table.

3. An apparatus as defined in claim 1 in which said connector means comprises a border adapter connected to said upstanding border of said play table, said border adapter comprising a clamping assembly and an adapter body portion connected to said clamping assembly.

4. An apparatus as defined in claim 1 in which said supporting arm of said extension means includes track gripping means for releasably gripping a section of the toy train track.

5. An apparatus as defined in claim 1 in which said supporting arm of said extension module includes a pair of upstanding connecting bosses.

6. An apparatus as defined in claim 5 further including first track elevation means connected to said connecting bosses for elevating a section of the toy train track above said supporting arm of said extension means.

7. An apparatus as defined in claim 6 in which said track elevation means comprises an elevation module comprising a supporting arm, a pair of tubular legs and a pair of spaced-apart, upstanding connector bosses connected to said supporting arm of said first track elevation means.

8. An apparatus as defined in claim 7 further including a second track elevation means connected to said upstanding connector bosses of said first elevation means for elevating a section of the toy train track above said supporting arm of said first track elevating means.

9. An apparatus as defined in claim 8 in which said second track elevation means includes a supporting arm, and said supporting arms of both of said first and second track elevation means are provided with an elongated slot adapted to receive gripping means for gripping a section of the toy train track.

10. A children's play apparatus for use with interconnectable sections of a toy train track which includes straight, curved, flat, ascending and descending track sections that can be connected together to form a toy train track, said apparatus comprising:

(a) a play table .having a central portion having an upper surface and an upstanding border circumscribing said central portion, said upstanding border having a plurality of circumferentially spaced, generally vertically extending bores provided therein;

(b) track elevation means supported by said play table for elevating a section of the toy train track relative to said upper surface of said central portions of said play table; and (c) extension means for extending a section of the toy train track outwardly beyond said border of said play table, said extension means comprising an extension module having:

(i) a body portion;

(ii) a shank portion connected to said body portion, said shank portion being receivable within a selected one of said generally vertically extending bores of said border; and (iii) a track supporting arm connected to said body portion and extending outwardly therefrom.

11. An apparatus as defined in claim 10 in which said track elevation means comprises:

(a) a first body portion having a connector boss and a table-engaging surface for engaging said upper surface of said central portion of said play table; and (b) a second body portion connected to said first body portion, said second body portion having a socket for telescopically receiving said connector boss of said first body portion and a spaced-apart track supporting member for supporting a selection of the toy train track.

12. An apparatus as defined in claim 10 in which said track supporting arm of said extension means includes a pair of upstanding connecting bosses.

13. An apparatus as defined in claim 12 in which said track elevation means comprises a first elevation module connected to said connecting bosses for elevating a section of the toy train track above said track supporting arm.

14. An apparatus as defined in claim 13 in which said first elevation module includes a pair of tubular legs, a track supporting arm connected to and spanning said tubular legs, and a pair of spaced-apart, upstanding connector bosses connected to said supporting arm.

15. An apparatus as defined in claim 14 further including a second elevation module connected to said upstanding connector bosses of said first elevation module for elevating a section of the toy train track above said supporting arm of said first elevation module.

* * * * *